US010465368B2

(12) United States Patent
Rosal

(10) Patent No.: US 10,465,368 B2
(45) Date of Patent: Nov. 5, 2019

(54) OBSTRUCTION CLEARING ASSEMBLY

(71) Applicant: Aries M. Rosal, West Covina, CA (US)

(72) Inventor: Aries M. Rosal, West Covina, CA (US)

( * ) Notice: Subject to any disclaimer, the term of this patent is extended or adjusted under 35 U.S.C. 154(b) by 0 days.

(21) Appl. No.: 15/985,981

(22) Filed: May 22, 2018

(65) Prior Publication Data

US 2018/0347170 A1 Dec. 6, 2018

Related U.S. Application Data

(60) Provisional application No. 62/513,780, filed on Jun. 1, 2017.

(51) Int. Cl.
*E03D 9/10* (2006.01)
*E03C 1/302* (2006.01)
*E03D 5/08* (2006.01)

(52) U.S. Cl.
CPC ..... *E03D 9/10* (2013.01); *E03C 1/302* (2013.01); *E03D 5/08* (2013.01)

(58) Field of Classification Search
CPC ... E03C 3/30; E03C 3/302; E03D 9/10; E03D 5/08
USPC ..... 4/256.1, 319
See application file for complete search history.

(56) References Cited

U.S. PATENT DOCUMENTS 3,585,650 A * 6/1971 Lekberg et al. ..... E03D 5/016 4/317
3,699,592 A * 10/1972 Minchak ..... E03D 9/10 4/320
3,757,375 A 9/1973 Strom et al.
4,174,548 A 11/1979 Dunn
4,644,603 A 2/1987 Meyer
5,500,974 A 3/1996 Wu
6,643,854 B1 11/2003 Jensen
6,898,807 B2 5/2005 Tash
7,765,626 B2 8/2010 Sapia
7,962,974 B2 6/2011 Lanier
10,280,604 B1 * 5/2019 Maresh ..... E03D 5/01
2007/0089254 A1 4/2007 Alaine
2007/0101484 A1 * 5/2007 Mehta ..... E03D 9/10 4/319
2009/0211008 A1 8/2009 Fucito
2011/0056007 A1 3/2011 Caywood et al.
2014/0026306 A1 1/2014 Rosal

* cited by examiner

*Primary Examiner* — Huyen D Le
(74) *Attorney, Agent, or Firm* — Kirk A. Buhler; Buhler & Associates Patenting

(57) ABSTRACT

An obstruction clearing assembly for clearing an obstruction from the P-trap to the waste outlet of the toilet. The assembly is positioned inside the toilet is accessible and controlled outside the fixture by a foot pedal which is connected to a flexible cable, which are aligned diagonally by a plurality of at least a dozen threads located outside of the assembly. A cable is connected to a chain with multiple joints and rotates the pulley wheels and rotors inside the assembly. The rotors move in conjunction with the obstruction inside the pipeline. A sleeve provides a rigid frame for the cable. A tensioner connects the cable and the cross bar. The pulley rollers change the direction of the cable from a diagonal to a vertical position and vice versa while the cross bar holds the tensioner that is connected to the chain and toilet base.

20 Claims, 4 Drawing Sheets

OBSTRUCTION CLEARING ASSEMBLY

CROSS REFERENCE TO RELATED APPLICATION

This application claims the benefit of Provisional Application Ser. No. 62/513,780 filed Jun. 1, 2017 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an obstruction clearing assembly. More particularly, one or more embodiments of the invention relate to clog removal devices for plumbing fixtures.

Description of Related Art Including Information Disclosed Under 37 CFR 1.97 and 1.98

The following is an example of a specific aspect in the prior art that, while expected to be helpful to further educate the reader as to additional aspects of the prior art, is not to be construed as limiting the obstruction clearing assembly, or any embodiments thereof, to anything stated or implied therein or inferred thereupon. Plungers are typically used to remove clogs. Additionally, chemicals are sometimes used to remove clogs. Plungers and chemicals are sometimes messy and can often be unsightly. Plungers may be difficult to use to completely remove a clog. Nearly all of the toilets in the market today do not have a built-in clog removal device. In view of the foregoing, it is clear that these techniques are not perfect and leave room for optional approaches.

A number of patents and or publications have been made to address these issues. Exemplary examples of patents and or publication that try to address this/these problem(s) are identified and discussed below.

U.S. Pat. No. 3,757,375 issued on Sep. 11, 1973 to Martin Strom discloses an Obstruction Removal Apparatus. The device is for extracting obstructions from confined spaces includes a flexible outer shaft movable relative to an inner central member. The central member is attached to the outer shaft and in a first embodiment, contains one or more teeth or claws. Upon insertion of the device into an obstructed space, the claws are retracted inside the shaft for easy passage past the obstruction. The apparatus is essentially a spring with barbs and does not have the ability to clear an obstruction by sweeping the side with a gear driven wheel.

U.S. Patent publication number 2011/0056007 was published on Mar. 10, 2011 to Matthew G. Caywood et al., and discloses a Toilet and Urinal Drain Unclogging Device and Method. The device and method include a plunger assembly, a central cylinder assembly and a rotating flexible rod assembly. By manually pushing the plunger assembly into the central cylinder assembly, a rotating flexible rod emerges from the bottom of the central cylinder assembly. This does not allow a person to sweep the sides of the tubes, it only provide a rotating snake.

What is needed is an obstruction clearing device that utilizes a drive system to sweep the sides of a toilet to clear the sides down to the drain. The obstruction clearing device disclosed in this document provides the solution.

BRIEF SUMMARY OF THE INVENTION

One or more embodiments of the obstruction clearing assembly generally relate to clog removal devices. More particularly, one or more embodiments of the obstruction clearing assembly relate to clog removal devices for plumbing fixtures.

It is an object of the obstruction clearing assembly to provide an assembly that both cleans and pushes obstructions in the drain line of a toilet. This apparatus can be completely or partially retained within the toilet or along the side of a toilet where it can be accessed from an access door.

It is an object of the obstruction clearing assembly for the assembly to be self-cleaned with the flushing of a toilet tank. The flushing of the tank washes past the clearing assembly to clean the apparatus.

It is another object of the obstruction clearing assembly to have a rotational tensioner that retracts a link chain that turns a plurality of rollers that allows the obstruction clearing portion of the assembly to bend between the tank and the bowl portion of a plumbing apparatus.

It is another object of the obstruction clearing assembly to include a plurality of rotors that are operable with a handle the handle has essentially a rack and pinion arrangement where the rotors are turned as the foot pedal is translated.

It is another object of the obstruction clearing assembly to include an optional motor drive that can be internally or externally powered to operate the rotors. This can be completely enclosed within the plumbing apparatus to clear an obstruction when needed.

In view of the foregoing, it is clear that these traditional techniques are not perfect and leave room for more optimal approaches.

Various objects, features, aspects, and advantages of the obstruction clearing assembly will become more apparent from the following detailed description of preferred embodiment of the obstruction clearing assembly, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1A:
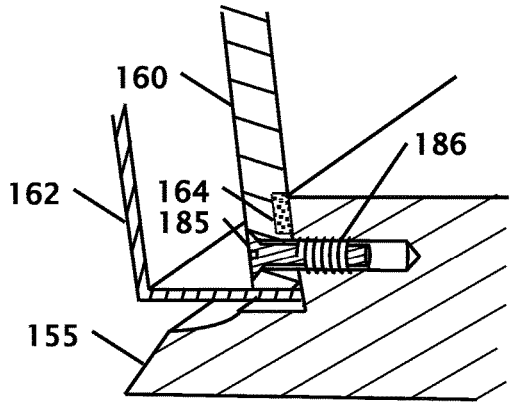
FIG. 1A shows a detail of the sealing of the mounting plate with the toilet.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

Figure 1:
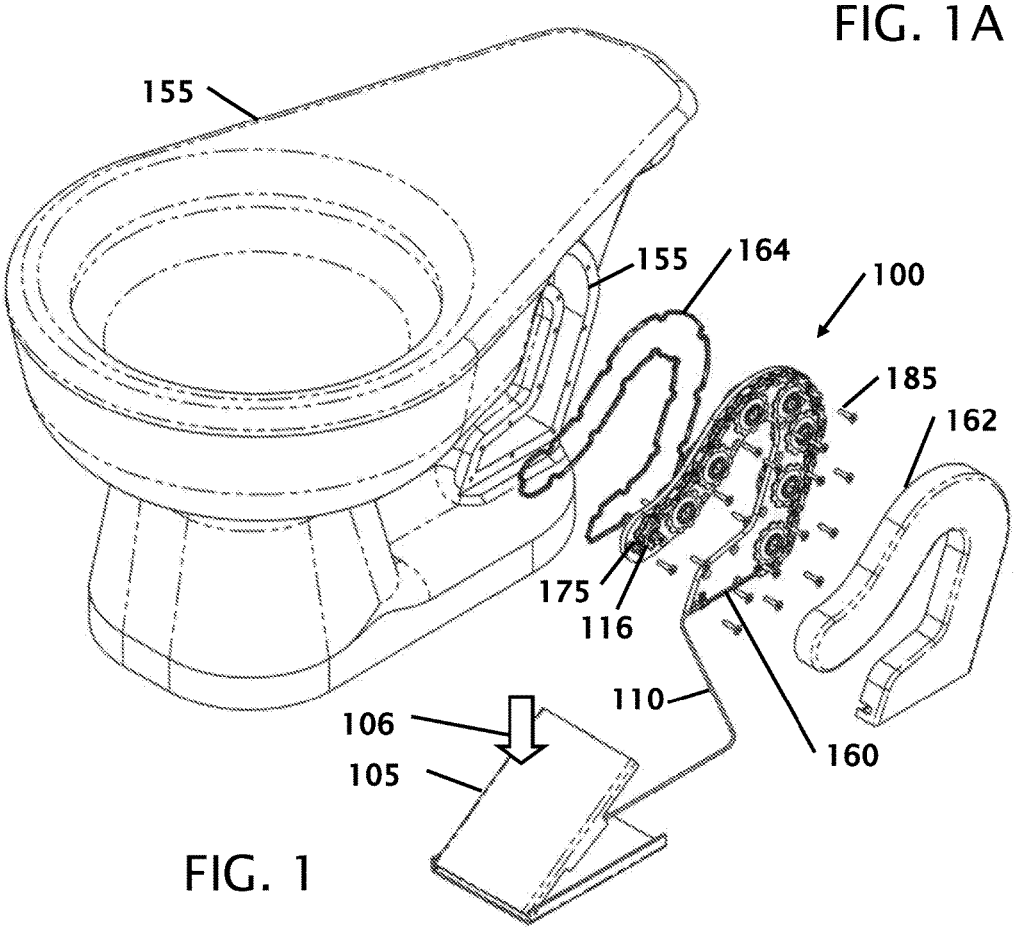
FIG. 1 shows a side perspective view of the obstruction clearing assembly on a toilet.

100 obstruction clearing assembly
105 foot pedal
106 down
107 lift
108 cable
110 cable
115 sleeve
116 lever
120 side rail
135 link chain
136 connecting link
140 pulley wheel
145 rod
150 pulley roller
151 recess
155 toilet
160 mounting plate
161 fasteners
162 cover
164 gasket
165 rotor
166 turn
167 teeth
170 teeth
171 nubs
175 tensioner
176 pulls
185 rivet/screw/fastener
186 threaded insert
191 bearing
192 link connector
195 washer
196 fastener
197 last link
198 key FIG. 1 shows a side perspective view of the obstruction clearing assembly on a toilet 155. The toilet 155 has been manufactured or modified to accept the obstruction clearing assembly. The side of the toilet 155 has a recess 151 that accepts a gasket 164 to seal the mechanism within the cover 162. There is an internal portion of the obstruction clearing assembly that fits within the cover 162, and a foot pedal 105 that is pushed down 106 to turn the internal mechanism of the obstruction clearing assembly to grind or push any obstruction down the toilet 155. A cable 110 connects the foot pedal 105 to the internal mechanism of the obstruction clearing assembly.

The obstruction clearing assembly has a cable that drives the grinding hubs. At the end of the cable is a lever 116 on a torsion spring tensioner 175 that returns the foot pedal 105 to an elevated position. The internal operating mechanics of the obstruction clearing assembly is shown and described herein. It is contemplated that the foot pedal 105 can be replaced with a reciprocating motor that is operated with a switch that duplicates the pumping motion. A fasteners 185, such as a screws secure the mounting plate 160 with the gasket 164 on the toilet 155.

FIG. 1A shows a detail of the sealing of the mounting plate 160 with the toilet 155. The gasket 164 is secured with a screw 185 to seal the mounting plate 160 to the toilet. A threaded insert, such as a Helicoil™ is inserted into the body of the toilet 155. The cover 162 provides a cosmetic finish to the obstruction clearing device and protects the mechanical link chain and sprockets.

Figure 3:
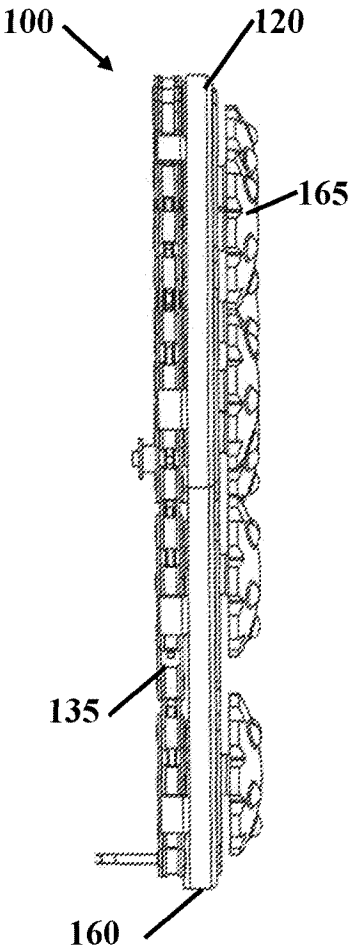
FIG. 3 shows a side view of the obstruction clearing device with the clearing teeth.
Figure 2:
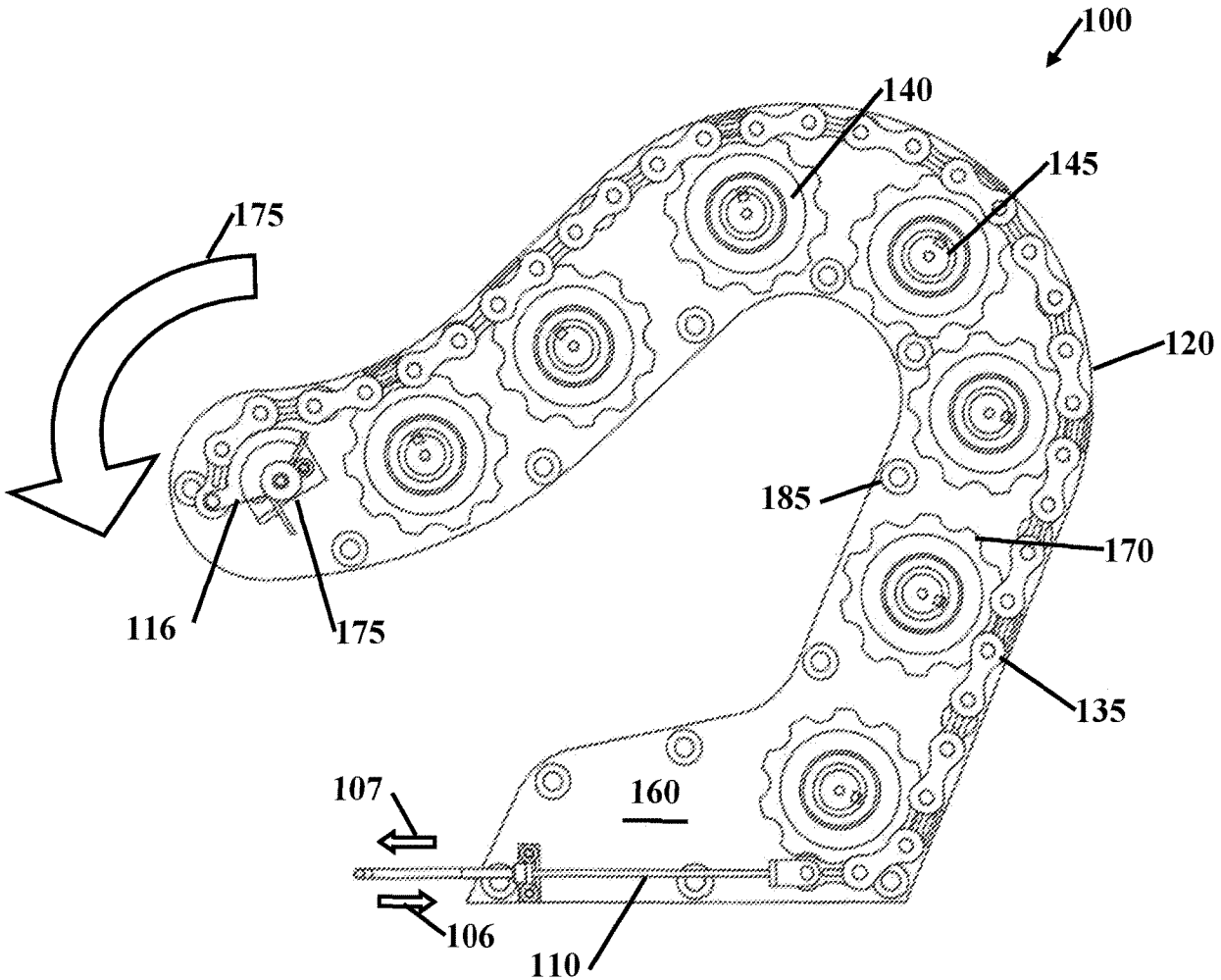
FIG. 2 shows a plan view of the outer side mechanism of the obstruction clearing device.

FIG. 2 shows a plan view of the outer side mechanism of the obstruction clearing device 100 and FIG. 3 shows a side view of the obstruction clearing device 100 with the clearing teeth on the rotor 165.

In the embodiment shown, a plurality of pulley wheels 140 are attached to the mounting plate 160. The pulley wheels 140 are about 1½ inch circumference and about ¼ inch thick. These dimensions are given as a reference, but other dimensions for these components is contemplated that will sufficiently operate and will fit within the openings in a toilet. A rod 145 connects through the pulley 140 to connect to a rotor 165 on the other side of the mounting plate 160. The plate 160 is secured with fasteners 161. The link chain 135 connects all of the pulley wheels 140 so they turn in unison. Suitable materials for these components are plastics, aluminum, steel and stainless steel.

The link chain 135 is essentially similar to a chain that is used on bicycle sprockets. The link chain 135 can be attached on the teeth 170 that engage in the pulley wheels 140. The chain 135 is configured to rotate the pulley wheel 140 and rotor 165 on the other side of the mounting plate 160. Suitable materials for these components are plastics, aluminum, steel and stainless steel.

In the embodiment shown, the rod 145 through the pulley wheel 140 is configured to hold the pulley wheel 140, rotor 165, and mounting plate 160 at the same time. Suitable materials for these components are plastics, aluminum, steel and stainless steel.

The pulley wheel 140 is shown with at least 10 teeth 170 that are placed around the pulley wheel 140 on a first side of the mounting plate 160 and around the rotor 165 on a second side of the mounting plate 160. While 10 teeth are shown, and described, more or less than 10 teeth can be used. In at least two portions of the obstruction clearing device, the teeth allow the pulley wheel 140 and rotor to rotate back/down 106 and forth/lift 107 upon stepping on and off of a foot pedal to pull on the cable 110.

The mounting plate 160 is configured to hold some of the parts namely; the pulley wheel 140, the side rail 120, the rod 145, the rivet screw or fastener 185 and the rotor 165. Suitable materials for these components are plastics, aluminum, steel and stainless steel.

In at least one embodiment of the obstruction clearing device 100, the side rail 120 is configured as barrier in order to prevent the chain 135 from misalignment as the chain 135 moves around the teeth 170 of the pulley wheel 140.

Suitable materials for these components are plastics, aluminum, steel and stainless steel.

A tensioner 175 is used to pull back the link chain 135 as a foot is released from the foot pedal. The tensioner 175 is essentially a torsion spring connected to a lever 116. The end of the lever 116 is connected to the end of the last link chain 135. The tensioner 175 pulls 176 on the last link of the link chain 135 to pull back 106 on the cable. When a person steps down on the foot pedal 105 (shown in FIG. 1) tension in the cable 110 will overcome the force of the tensioner 175 and pull the link chain 135 to turn the pulley wheels 140 that will turn the rotors 165. The bi-directional rotation will change the direction of rotation and essentially grind any material in the toilet drain. Suitable materials for these components are plastics, aluminum, steel and stainless steel. The cable 110 is preferably enclosed in a sleeve 115. Suitable materials for these components are plastics, aluminum, steel and stainless steel.

Figure 5:
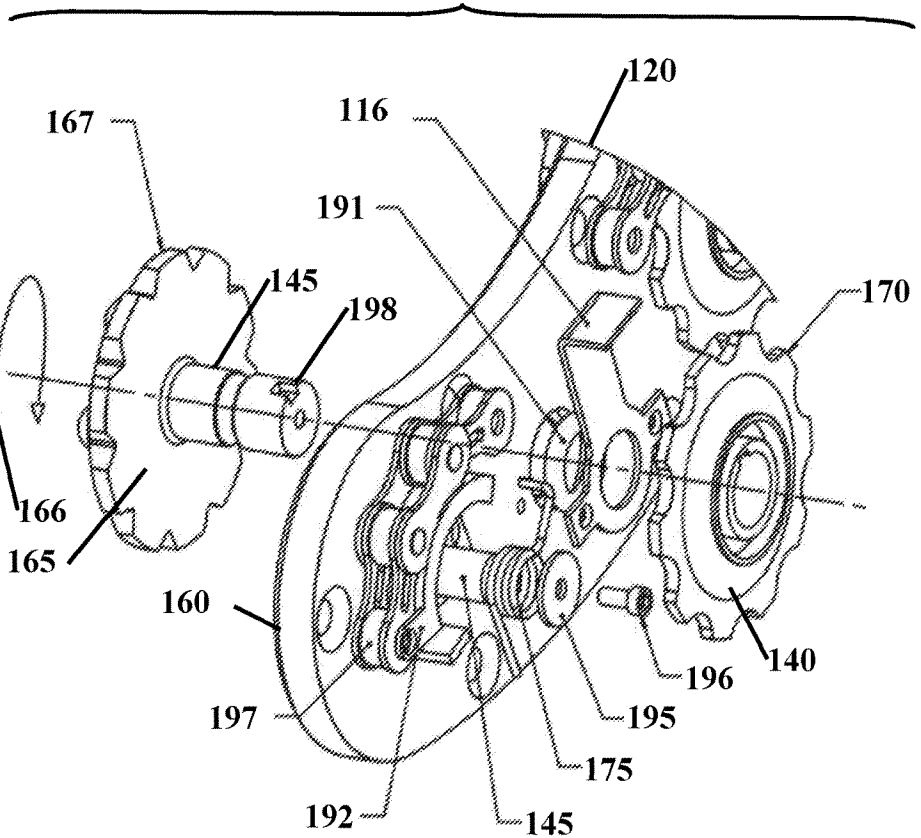
FIG. 5 shows a detail view of the tensioner portion.
Figure 4:
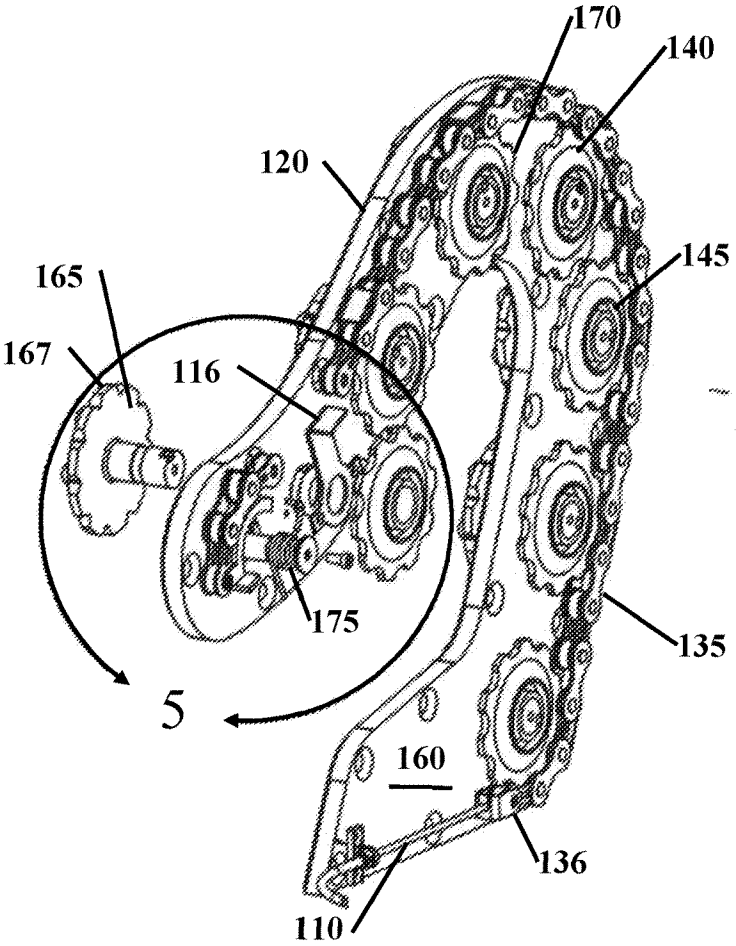
FIG. 4 shows a perspective view of the operating portion of the obstruction clearing device.

FIG. 4 shows a perspective view of the operating portion of the obstruction clearing device and FIG. 5 shows a detail view of the tensioner portion. The cable 110 is shown connected into the bottom of the mounting plate 160. The cable connects to a connecting link 136 and into one end of the link chain 135. The link chain 135 wraps around the edge of the mounting plate 160. The side rail 120 maintains the link chain 135 in contact with the teeth 170 on the plurality of pulley wheels 140. The far end of the link chain 135 terminates with a link connector 192. The link connector 192 has a curved arc sector section capstan to allow links of the chain to wrap around the link connector 192. The link connector 192 is moved with a lever arm 116 that is rotated with tensioner 175 spring.

The rotor 165 has a rod 145 that extends out of one side of the rotor 165. The rod 145 passes through the mounting plate 160. The rod 145 has a key 198 that locks the pulley wheel 140 relative to the rotor 165 so they rotate or turn 166 together. The rotor 165 has teeth 167 to loosen, move or grind material that may be clogging the drain of the toilet. An O-ring or similar sealing mechanism prevents fluid from the toilet to pass through the mounting plate 160. The rod 145 connects through a bearing 191 and capped with a washer 195 and a fastener 196 such as a screw. The tensioner 175 spring pulls the last link 197 of the chain back. While tension on the cable 110 pulls on the other end of the link chain 135. This reciprocating motion results in counter rotation 166 of the rotor 165.

Figure 6:
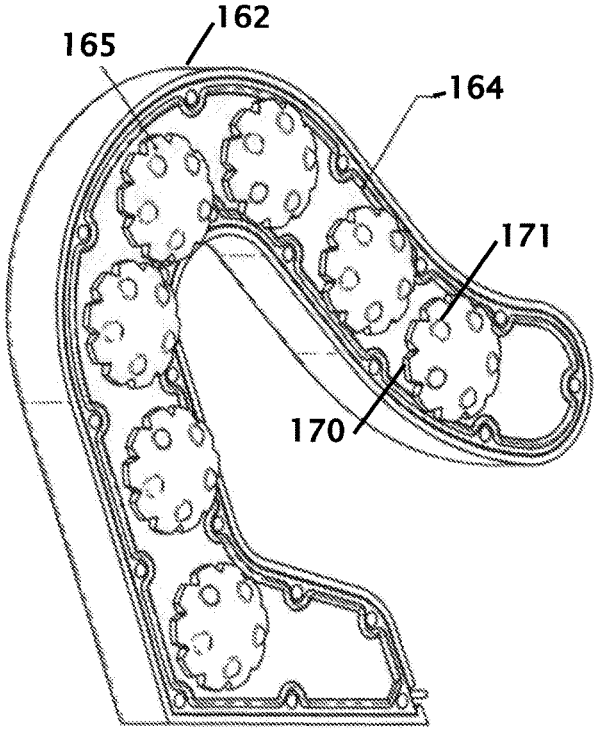
FIG. 6 shows a perspective view of the rotors.

FIG. 6 shows a perspective view of the rotors 165. The rotors 165 are exposed to the interior drain path of a toilet. The rotors 165 are on the inside of the cover 162. The rotors 165 has a plurality of grinding teeth 170 and nubs 171 for grinding and disturbing a clog in the toilet to allow a clog in the toilet to be displaced without requiring the use of a plunger. A gasket 164 seals the cover 162 onto the side of the toilet as shown in FIG. 7.

Figure 7:
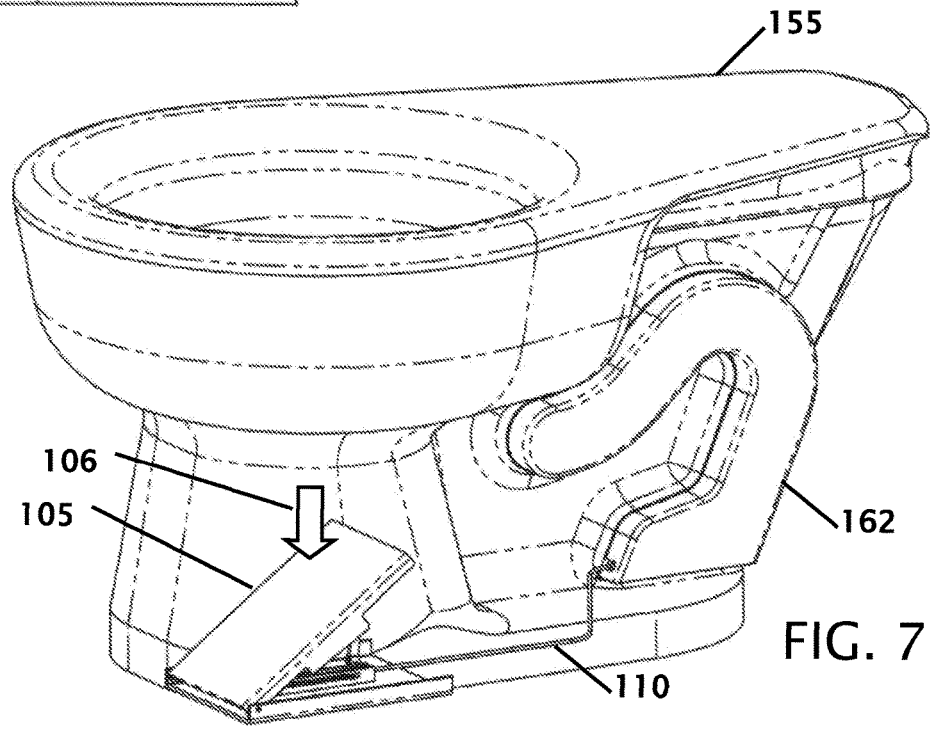
FIG. 7 shows a perspective view of the finished toilet with the obstruction clearing device thereon.

FIG. 7 shows a perspective view of the finished toilet with the obstruction clearing device thereon. In a contemplated embodiment, the foot pedal 105 is disposed. In at least one embodiment of the present obstruction clearing assembly, the foot pedal 105 pulls 106 the cable 110 that is connected to the previously disclosed link chain to rotate the previously disclosed sprockets and rotors 165. The obstruction clearing assembly for the clog removal device to be accessible from outside on the side of the toilet 155 at the cover 162. The cover 162 can be held on the side of the toilet 155 with fasteners or with snaps.

Having fully described at least one embodiment of the present obstruction clearing assembly, other equivalent or alternative methods of implementing clog removal devices according to the present obstruction clearing assembly will be apparent to those skilled in the art. The obstruction clearing assembly has been described above by way of illustration, and the specific embodiments disclosed are not intended to limit the obstruction clearing assembly to the particular forms disclosed. The particular implementation of the clog removal devices may vary depending upon the particular context or application for example a toilet, verses kitchen or vanity sink. By way of example, and not limitation, the clog removal devices described in the foregoing were principally directed to clog removal devices for toilets implementations.

Thus, specific embodiments of an obstruction clearing assembly have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An obstruction clearing assembly comprising:
a toilet that includes a cable;
said cable is connected to a link chain with multiple links;
said link chain operates a plurality of sprockets;
said plurality of sprockets turn a plurality of rotors, and
a pedal connected to said cable that pulls on a first end of said link chain.

2. The obstruction clearing assembly of claim 1, wherein said plurality of sprockets are mounted on a mounting plate.

3. The obstruction clearing assembly of claim 2, wherein said plurality of sprockets are on a first side of said mounting plate and each sprocket is connected with a separate rod to a complimentary rotor.

4. The obstruction clearing assembly of claim 2, wherein said link chain is guided by a side rail on said mounting plate.

5. The obstruction clearing assembly of claim 2, wherein a gasket seals said mounting plate to said toilet.

6. The obstruction clearing assembly of claim 1, wherein a second end of said link chain is connected to a tensioner.

7. The obstruction clearing assembly of claim 6, wherein said tensioner is a torsion spring.

8. The obstruction clearing assembly of claim 6, wherein said tensioner connects to said link chain with a curved arc sector section capstan.

9. The obstruction clearing assembly of claim 6, wherein said tensioner pulls said link chain and at least a portion of said cable into a mounting plate.

10. The obstruction clearing assembly of claim 9, wherein said tensioner elevates said pedal.

11. The obstruction clearing assembly of claim 10, wherein depression of said pedal imparts rotational motion onto said rotors.

12. The obstructions clearing assembly of claim 11, wherein said pedal is configured to overcome said tensioner and pull at least a portion of said cable out of said mounting plate.

13. The obstruction clearing assembly of claim 1, wherein said obstruction clearing assembly is covered with a cap or cover on an outside of said toilet.

14. The obstruction clearing assembly of claim 13, wherein removal of said cap or cover allow access to said obstruction clearing assembly without unsealing a fluid path of said toilet.

15. The obstruction clearing assembly of claim 1, wherein said plurality of sprockets is seven sprockets.

16. The obstruction clearing assembly of claim 15, wherein said seven sprockets are arranged to follow a drain path of said toilet.

17. The obstruction clearing assembly of claim 1, wherein said plurality of rotors are arranged to follow a drain path of said toilet.

18. The obstruction clearing assembly of claim 17, wherein said plurality of rotors each have at least one tooth and at least one nub that is configured to disrupt a clog in a toilet drain path.

19. The obstruction clearing assembly of claim 1, wherein said assembly is secured to at least one side of said toilet.

20. The obstruction clearing assembly of claim 1, wherein said cable is covered with a sleeve that is configured to allow said cable to move within said sleeve.

* * * * *